US005357695A

United States Patent [19]

Lu

[11] Patent Number: 5,357,695

[45] Date of Patent: Oct. 25, 1994

[54] INTERCHANGEABLY ASSEMBLED SHOE

[75] Inventor: Jinny Lu, Taichung, Taiwan

[73] Assignee: Montype Supply Co., Ltd., Taichung, Taiwan

[21] Appl. No.: 138,976

[22] Filed: Oct. 21, 1993

[51] Int. Cl.[5] ..... A43B 5/16; A43B 7/08

[52] U.S. Cl. ..... 36/115; 36/3 A; 36/3 R

[58] Field of Search ..... 36/115, 100, 101, 3 R, 36/3 A, 15, 77 R; 280/11.12, 841, 11.3, 11.33

[56] References Cited

U.S. PATENT DOCUMENTS

| | | | |
|---|---|---|---|
| 1,986,580 | 1/1935 | Johnson | 36/115 |
| 4,126,323 | 11/1978 | Scherz | 280/11.12 |
| 4,351,537 | 9/1982 | Seidel | 280/11.3 |
| 4,509,276 | 4/1985 | Bourque | 36/115 |
| 4,771,555 | 9/1988 | Ohashi | 36/3 A |
| 4,906,013 | 3/1990 | Hussien et al. | 280/11.12 |
| 4,988,122 | 1/1991 | Saunders | 280/11.12 |
| 4,995,174 | 2/1991 | Hong et al. | 36/77 R |
| 5,171,033 | 12/1992 | Olson et al. | 36/115 |
| 5,193,827 | 3/1993 | Olson | 280/11.13 |

FOREIGN PATENT DOCUMENTS 8446 12/1905 United Kingdom ..... 36/3 A

*Primary Examiner*—Steven N. Meyers

[57] ABSTRACT

An interchangeably assembled shoe includes: a sole mounted on a foot sporting article such as a roller skate, a rear shield detachably secured to an ankle portion of the sole by plural ventilation couplings each ventilation coupling serving for coupling and ventilation uses, a toe box member detachably secured to a toe portion of the sole and replaceable for different decorative features on the toe box member, plural instep members selected from a full tongue member, a shoelace member and a fastener member for selectively securing anyone desired instep member on a middle section of the shoe by plural ventilation couplings, a plurality of ventilation couplings further secured on the toe box member or on the toe portion of the shoe fluidically communicating with a shoe interior for a well ventilation in the shoe for comforting a wearer's foot, a lining inserted in the shoe, and a plurality of buckle devices fastened on the shoe for firmly fastening the instep member with the rear shield and fastening the instep member on the sole for stably wearing a wearer's foot whether bare foot or already wearing a footwear thereon.

9 Claims, 5 Drawing Sheets

INTERCHANGEABLY ASSEMBLED SHOE

BACKGROUND OF THE INVENTION

A conventional boot secured on a roller skate is made as fixed type, which can not be optionally changed unless further buying a new or different shoes when manufacturing the shoes of different styles, it is necessary to provide plural processing equipments, such as diversified shoes molds for different shoes, thereby increasing investment and production cost.

It is therefore desired to invent a shoe which can be constructed by assembling several shoe elements or members of different styles for selectively assembling any shoes of desired style.

SUMMARY OF THE INVENTION

The object of the present invention is to provide an interchangeably assembled shoe including: a sole mounted on a foot sporting article such as a roller skate, a rear shield detachably secured to an ankle portion of the sole by plural ventilation couplings, a toe box member detachably secured to a toe portion of the sole and replaceable for different decorative features on the toe box member, plural instep members selected from a full tongue member, a shoelace member and a fastener member for selectively securing anyone desired instep member on a middle section of the shoe by plural ventilation couplings, a plurality of ventilation couplings further secured on the toe box member or on the toe portion of the shoe fluidically communicating with a shoe interior for a well ventilation in the shoe for comforting a wearer's foot, a lining inserted in the shoe, and a plurality of buckle devices fastened on the shoe for firmly fastening the instep member with the rear shield and fastening the instep member on the sole for stably wearing a wearer's foot whether bare foot or already wearing a footwear thereon.

DETAILED DESCRIPTION

Figure 1:
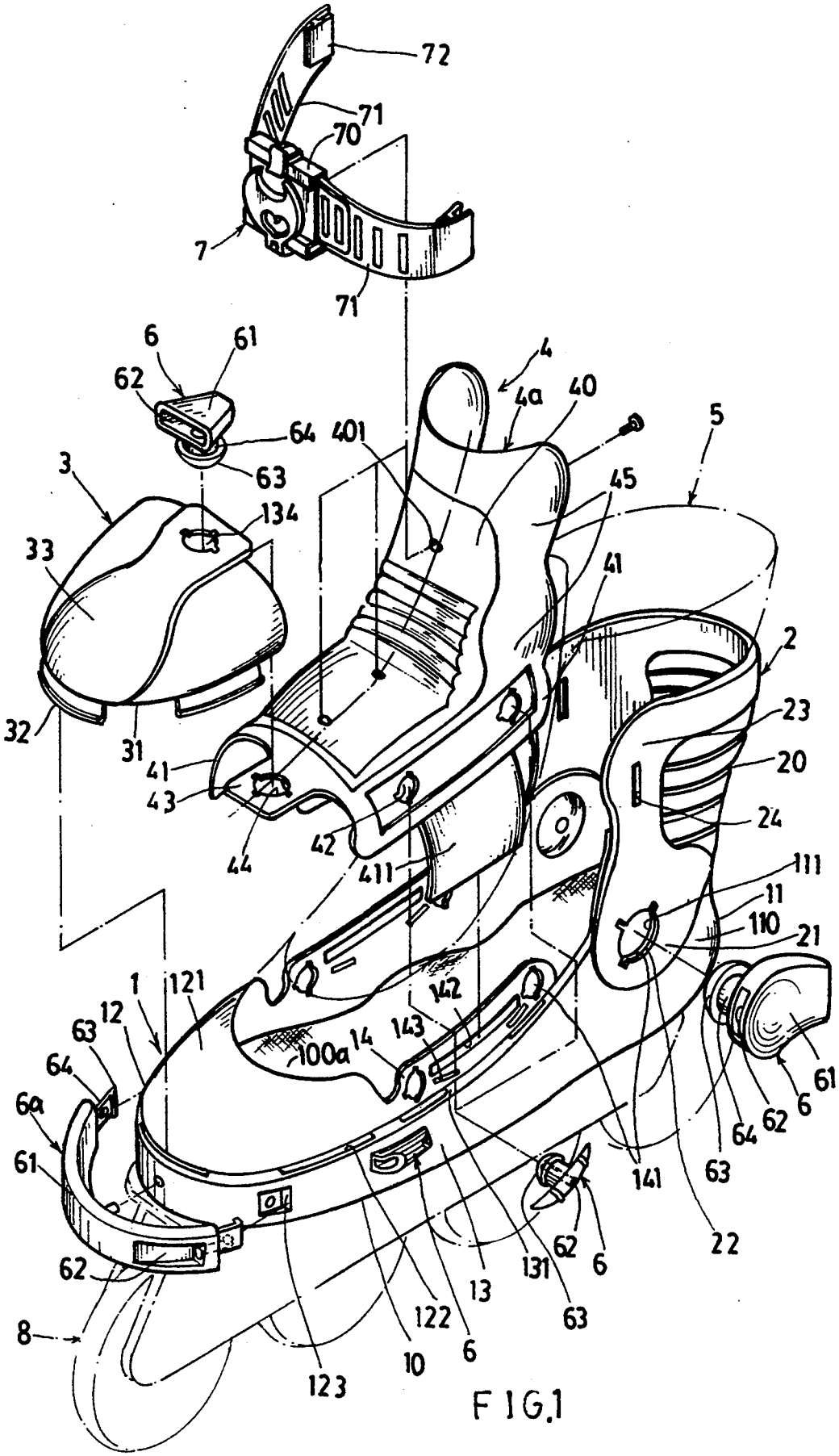
FIG. 1 is an illustration showing elements in construction of the present invention.
Figure 2:
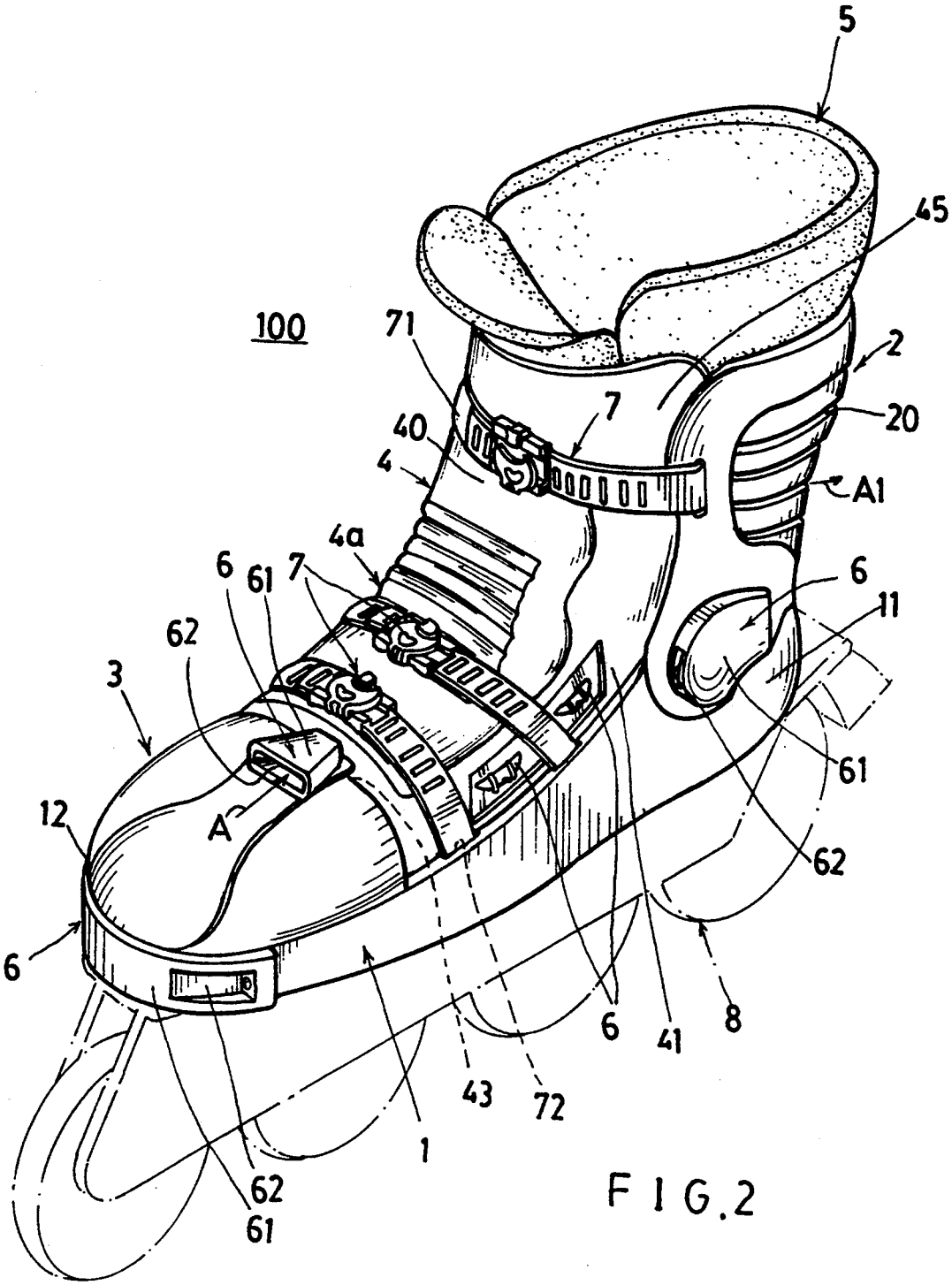
FIG. 2 is a perspective view of the present invention as assembled from FIG. 1.

As shown in FIGS. 1 and 2, an assembled shoe 100 of the present invention comprises; a sole 1 mounted on a foot sporting article 8 such as a roller skate, a rear shield 2, a toe box member 3, an instep member 4, a lining 5 inserted in the shoe 100, a plurality of ventilation couplings 6 and buckle means 7 provided on the shoe.

The sole 1 includes: a sole bottom 10 secured with the foot sporting article 8 such as a roller skate or other sporting articles; an ankle portion 11 having an ankle flap 110 protruding upwardly from the ankle portion 110 for securing the rear shield 2 and at least two inner coupling openings 111 formed through the ankle flap 110; a toe portion 12 having a toe flap 121 protruding upwardly from the toe portion 12 for shielding wearer's toes and for mounting the toe box member 3 thereon, a plurality of front cavities 122 recessed in the toe portion 12 of the sole 1; a pair of intermediate side sole portions 13 each side sole portion 13 having a plurality of side cavities 131 recessed therein for securing each said buckle means 7 or for securing the instep member 4 therein; and a pair of side flaps 14 each side flap 14 formed with at least a coupling opening 141, an elongated slot 142 and a short slot 143 for securing the ventilation coupling 6 and the instep member 4 therein.

The rear shield 2 includes: a plurality of rear ventilation slots 20 formed on a rear portion of the rear shield 2 for ventilating air outwardly from the shoe interior 100*a*, a lower skirt portion 21 having at least two outer coupling openings 22 formed through the lower skirt portion 21 matching with the two inner coupling openings 111 of the sole 1 for insertion of a ventilation coupling 6 in the outer and inner coupling openings 22, 111 for coupling the rear shield 2 on an ankle portion 11 of the sole 1, and a pair of side cover portions 23 disposed on two opposite sides of the rear shield 2 having a buckle slot 24 formed in each said side cover portion 23 for securing a buckle means 7 for fastening an instep member 4 with the rear shield 2 as shown in FIG. 2.

The toe box member 3 includes: a plurality of latches 32 generally formed as ratchet teeth each latch 32 protruding downwardly from a bottom rim 31 of the toe box member 3 to engage a front cavity 122 in the sole 1 for securing the toe box member 3 on the toe portion 12 of the sole 1 overlain on the toe flap 12, a decorative feature 33, which may be formed with different features, designs or contents or different toe box members 3 for selective decorative uses, formed on an upper surface of the toe box member 3 and at least a coupling opening 34 formed in the toe box member 3 to be fixed with a ventilation coupling 6 therein for ventilating air inwardly or outwardly of the shoe interior 100*a*.

Figure 3:
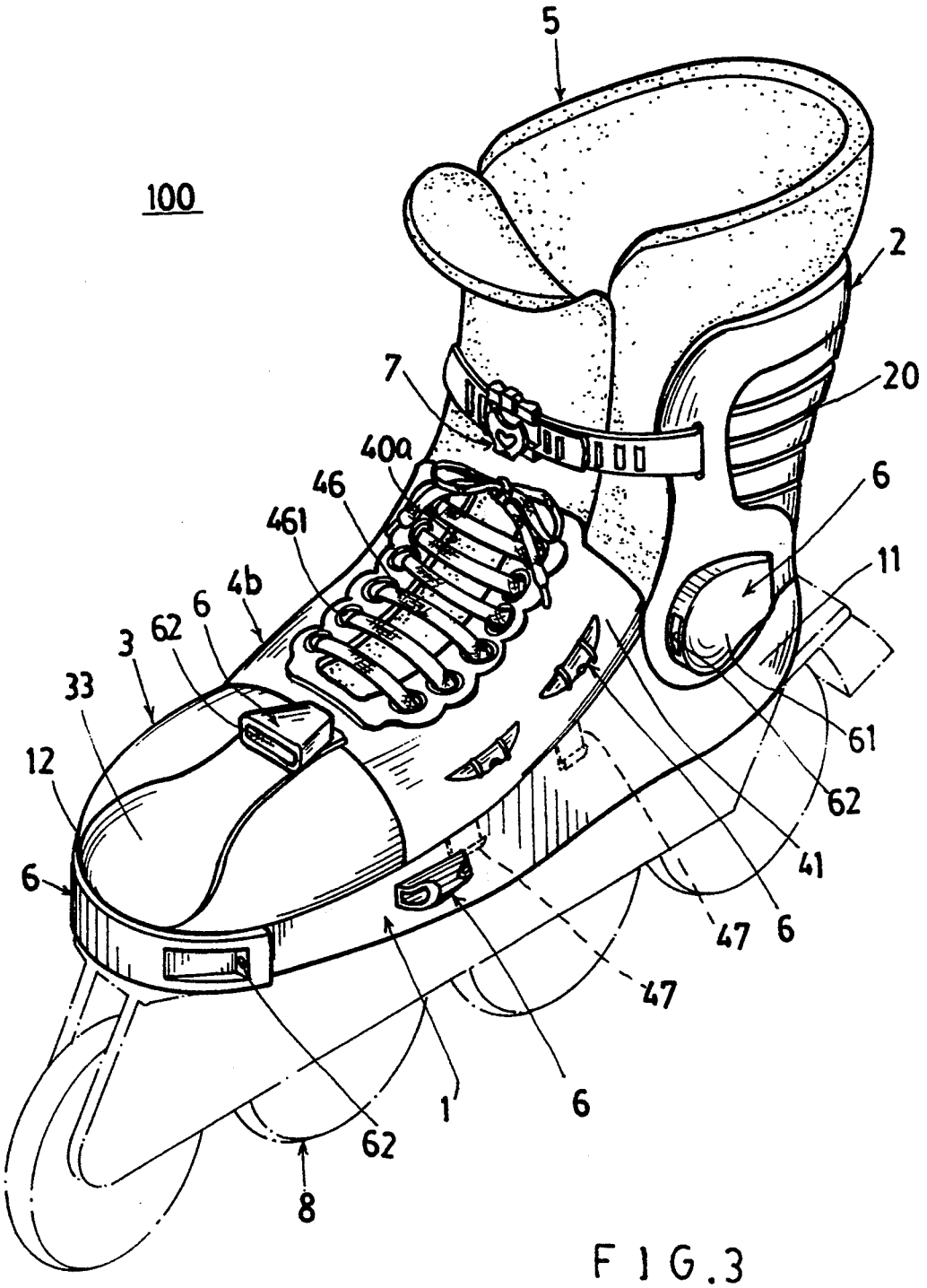
FIG. 3 is a perspective view of the present invention by substituting another preferred instep member on the sole.
Figure 3A:
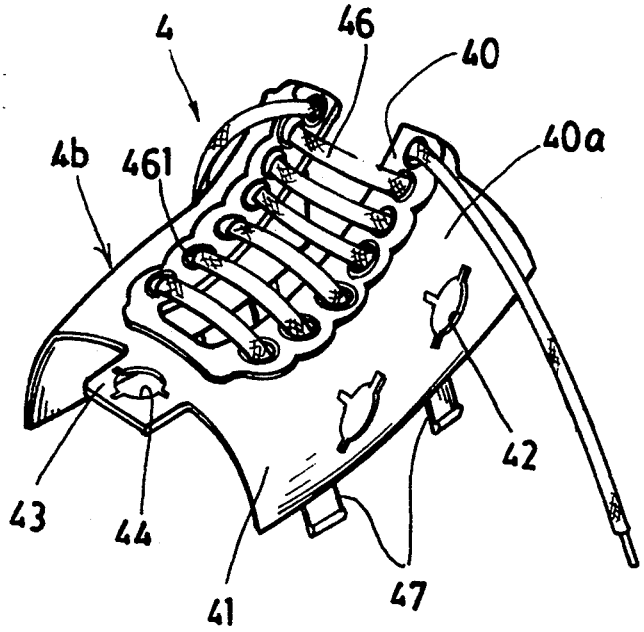
FIG. 3A shows the instep member as shown in FIG. 3.
Figure 4A:
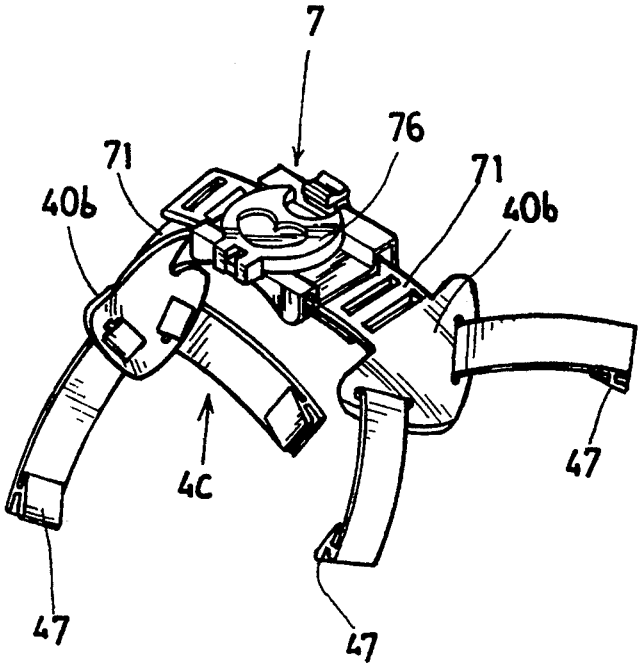
FIG. 4A shows an instep member as used in FIG. 4.
Figure 4:
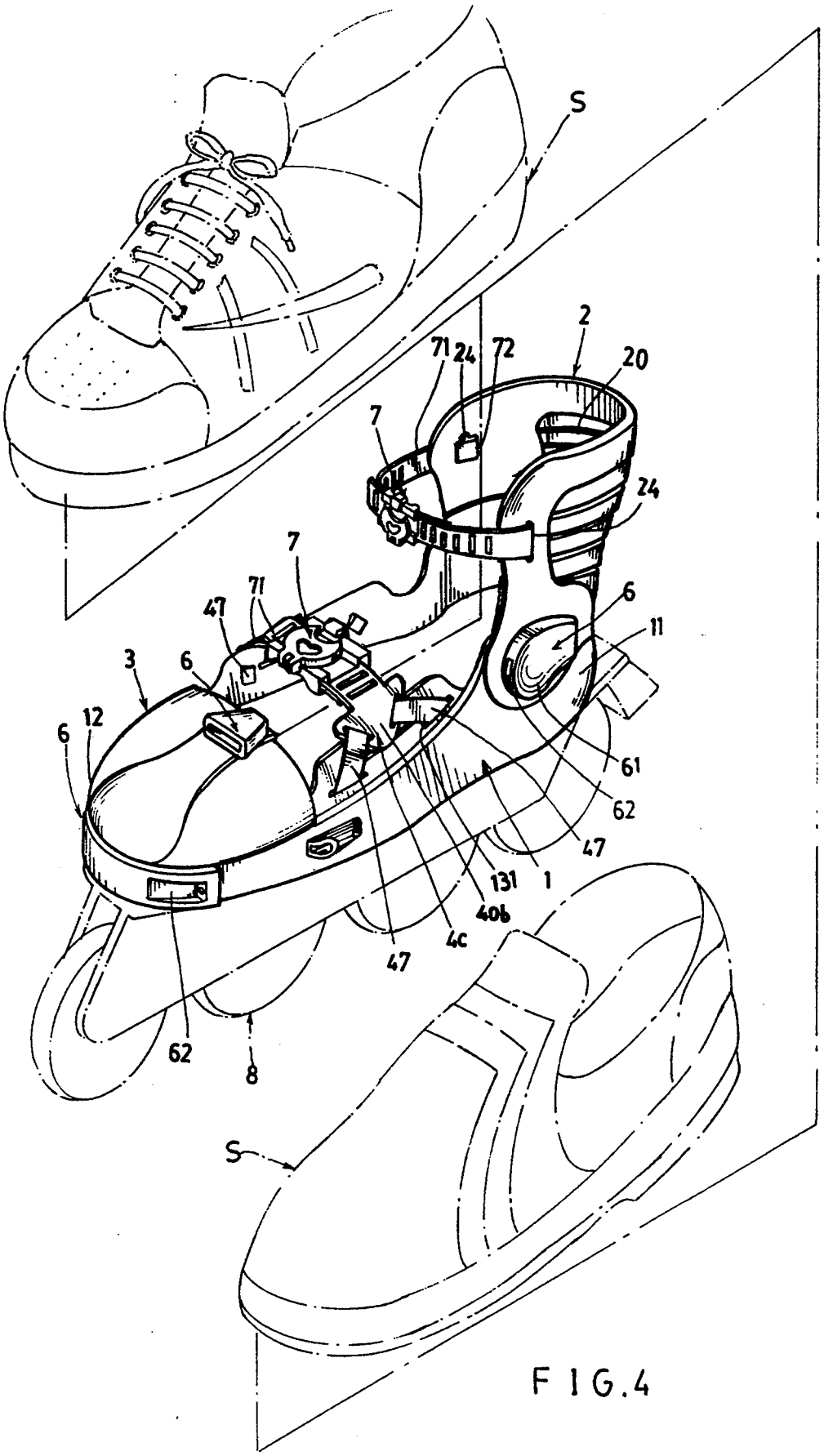
FIG. 4 is an illustration of the present invention adapted for further fastening a wearer's foot already wearing a footwear.

The instep member 4 may be a full tongue member 4*a* as shown in FIGS. 1, 2; or a shoelace member 4*b* as shown in FIGS. 3, 3A; or a fastener means or member 4*c* as shown in FIGS. 4, 4A.

The instep member 4*a* as shown in FIGS. 1, 2 includes: a central flap 40 having a plurality of screw holes 401 therein for securing each buckle means 7 in each screw hole 401, a pair of side wing portions 41 protruding downwardly from the central flap 40 having a plurality of side coupling openings 42 formed in each side wing portion 41 and matching with the coupling openings 141 of each side flap 14 of the sole 1 so that the instep member 4*a* can be secured to the sole 1 as coupled by a plurality of ventilation couplings 6, a front tab 43 protruding frontwardly from the instep member 4*a* having a front coupling opening 44 formed in the front tab 43 to match with a coupling opening 34 formed in the toe box member 3 for combining the front tab 43 with the toe box member 3 by a ventilation coupling 6 through the coupling openings 44, 34 in the instep member 4*a* and the toe box member 3, a pair of rear edge portions 45 formed on two opposite side edge portions of the instep member 4*a* to be tangentially contiguous to two side cover portions 23 of the rear shield 2 to be fastened with the rear shield 2 by a buckle means 7.

Each ventilation coupling 6 includes: an air port 62 for directing air inwardly into an air passage (not shown) formed in a hollow portion through the coupling 6, and a coupling head 63 formed on an inner end of the coupling 6 the coupling head 63 insertable in each coupling opening of relevant members to be coupled in this invention.

The ventilation coupling 6 such as used in the toe box member 3 may further include: a hood portion 61 in which the air port 62 is formed, and a connector or adapter 64 connected between the hood portion 61 and the coupling head 63.

The buckle means 7 includes: a buckle body 70 secured on an instep member 4 by screws 401 as shown in FIG. 1, two straps 71 adjustably fastened on the buckle body 70, each strap 71 having a latch 72 secured to either a buckle slot 24 formed in the rear shield 2 or in a side cavity 131 in the sole.

A front ventilation coupling 6*a* has its coupling heads 63 inserted into plural front ventilation openings 123 for directing air into shoe interior 100*a* through the sole 1.

The buckle means 7 of this invention may be referred to the inventor's previously filed invention entitled "Centrally Fastened Buckle Means for Shoes" given a serial number of: 08/113,349, filed in U.S. Patent and Trademark Office on Aug. 30, 1993, which is not described in detail herewith.

The instep member 4*b* as shown in FIG. 3, 3*a* includes: a central flap 40*a* having a shoelace 46 wound in and passing through a plurality of eyelets 461 formed in the central flap 40*a*, a front tab 43 protruding frontwardly from the central flap 40*a* having a front coupling opening 44 formed in the front tab 43 to be matched with a coupling opening 34 formed in the toe box member 3 for securing the front tab 43 with the toe box member 3 as coupled by a ventilation coupling 6, a plurality of side coupling openings 42 formed in two opposite side portions of the central flap 40*a* to match with a plurality of coupling openings 141 formed in two side flaps 14 on the sole 1 for inserting each ventilation coupling 6 in the coupling openings 141, 42 in the sole 1 and in the instep member 4*b* for securing the instep member 4*b* with the sole 1, and a plurality of latches 47 protruding downwardly from a bottom of the instep member 4*b* each latch 47 engaged with each side cavity 131 recessed in the sole 1 for further securing the instep member 4*b* to the sole 1 as shown in FIG. 3.

The instep member 4*c* as shown in FIGS. 4, 4*a* includes: a pair of central flaps 40*b* each central flap 40*b* having two latches 47 secured to the sole 1, and each central flap 40*b* secured with a strap 71 to allow two said straps 71, 71 to be fastened on a buckle means 7 held in a central portion of the instep member 4*c*.

The side wing portion 41 of the instep member 4 as shown in FIGS. 1, 2 includes a lower wing portion 411 protruding downwardly from the side wing portion 41 for passing through an elongated slot 142 cut out in a side flap 14 of the sole 1 for firmly securing the instep member 4 on the sole 1.

Naturally, the latches 72, 47 of the buckle means 7 or the instep member 40*a* or 40*b* may also be engaged with plural short slots 143 cut out in the side flap 14 of the sole 1 for securing the buckle means 7 or instep member 40*a* or 40*b* on the sole 1.

The present invention has the instep member 4*c* as shown in FIG. 4 may be used to fasten a wearer's foot already worn with a footwear S so that a player does not require to strip his or her footwear S and may directly wear the present invention for convenient and stable wearing thereof.

The present invention has the following advantages:

1. The ventilation couplings 6 may be used to couple the rear shield 2 on an ankle portion 11 of the sole 1, to couple the instep member 4 with the sole 1 and/or the toe box member. Meanwhile, each ventilation coupling 6 has an air port 62 communicating with an air passage in the coupling 6 and communicating with a shoe interior 100*a* for well ventilation inside the shoe 100 for comforting the wearer's foot for hygienic purpose.

2. The instep members 4*a*, 4*b*, 4*c* and toe box members 3 of different decorative features 33 may be interchangeably assembled on the sole 1 for interesting uses or personal favorite, or for satisfying an owner's interest such as for do-it-yourself (D-I-Y) purpose. Also, diversified decorative features or favorite styles of the shoes can be optionally chosen.

3. Whenever making molds for the members or elements of this invention, a unique sole 1 may serve as a common or "master" base compatible with anyone of the different instep members 4 or toe box members 3, without making plural molds for the sole 1 for saving investment and production cost.

The couplings 6 may also be substituted with rivets for respectively mounting the rear shield 2, the instep member 4; and the tox box member 3 on the sole 1 by a plurality of rivets (not shown).

I claim:

1. An assembled shoe comprising:

a sole 1 mounted on a foot sporting article 8 having an ankle portion 11, a toe portion 12, and a pair of intermediate side sole portions 13 between said ankle portion 11 and said toe portion 12;

a rear shield 2 detachably coupled to said ankle portion 11 of said sole by a plurality of ventilation couplings 6; each said ventilation coupling 6 passing through said rear shield and said ankle portion for securing the rear shield 2 on said ankle portion 11 of said sole 1;

a toe box member 3 detachably embedded in a toe portion of said sole having at least one ventilation coupling 6 secured on said toe box member for coupling a front portion of an instep member with said toe box member;

the instep member 4 detachably secured to said pair of said intermediate side sole portions of said sole by a plurality of ventilation couplings 6;

a lining 5 inserted in said shoe for serving as a packing for a wearer's foot; and a plurality of buckle means 7 operatively fastening said instep member on said sole and fastening said instep member to said rear shield for firmly fastening said instep member and said rear shield for a stable wearing of the shoe; and each said ventilation coupling 6 having air passage formed therethrough for communicating a shoe interior with an outside of said shoe.

2. A shoe according to claim 1, wherein said sole 1 includes: a sole bottom 10 secured with the foot sporting article 8; said ankle portion 11 having an ankle flap 110 protruding upwardly from the ankle portion 110 for securing the rear shield 2 and at least two inner coupling openings 111 formed through the ankle flap 110; said toe portion 12 having a toe flap 121 protruding upwardly from the toe portion 12 for shielding wearer's toes and for mounting the toe box member 3 thereon, a plurality of front cavities 122 recessed in the toe portion 12 of the sole 1, a plurality of front ventilation openings 123 formed through the toe portion of the sole 1 communicating with a shoe interior 100*a*; each said intermediate side sole portion 13 having a plurality of side cavities 131 recessed therein for securing each said buckle means 7 and for securing the instep member 4 therein; and a pair of side flaps 14 each side flap 14 formed with at least a coupling opening 141.

3. A shoe according to claim 2, wherein said rear shield 2 includes: a plurality of rear ventilation slots 20 formed on a rear portion of the rear shield 2 for ventilating air outwardly from the shoe interior 100*a*, a lower skirt portion 21 having at least two outer coupling openings 22 formed through the lower skirt portion 21 matching with the two inner coupling openings 111 of the sole 1 for insertion of one said ventilation coupling 6 in the outer and inner coupling openings 22, 111 for coupling the rear shield 2 on an ankle portion 11 of the sole 1, and a pair of side cover portions 23 disposed on two opposite sides of the rear shield 2 having a buckle slot 24 formed in each said side cover portion 23 for securing one said buckle means 7 for fastening said instep member 4 with the rear shield 2.

4. A shoe according to claim 2, wherein said toe box member 3 includes: a plurality of latches 32 generally formed as ratchet teeth each latch 32 protruding downwardly from a bottom rim 31 of the toe box member 3 to engage a front cavity 122 in the sole 1 for securing the toe box member 3 on the toe portion 12 of the sole 1 overlain on the toe flap 12, a decorative feature 33 formed on an upper surface of the toe box member 3 and at least a coupling opening 34 formed in the toe box member 3 to be fixed with one said ventilation coupling 6 therein for ventilating air inwardly or outwardly of the shoe interior 100*a*.

5. A shoe according to claim 2, wherein said instep member 4*a* includes: a central flap 40 having a plurality of screw holes 401 therein for securing each said buckle means 7 in each screw hole 401, a pair of side wing portions 41 protruding downwardly from the central flap 40 having a plurality of side coupling openings 42 formed in each side wing portion 41 and matching with the coupling openings 141 of each side flap 14 of the sole 1 so that the instep member 4*a* is secured to the sole 1 by a plurality of said ventilation couplings 6, a front tab 43 protruding frontwardly from the instep member 4*a* having a front coupling opening 44 formed in the front tab 43 to match with a coupling opening 34 formed in the toe box member 3 for combining the front tab 43 with the toe box member 3 by said ventilation coupling 6 through the coupling openings 44, 34 in the instep member 4*a* and the toe box member 3, a pair of rear edge portions 45 formed on two opposite side edge portions of the instep member 4*a* to be tangentially contiguous to two side cover portions 23 of the rear shield 2 to be fastened with the rear shield 2 by one said buckle means 7.

6. A shoe according to claim 1, wherein each said ventilation coupling 6 includes: an air port 62 for directing air inwardly into an air passage formed in a hollow portion through the coupling 6, and a coupling head 63 formed on an inner end of the coupling 6 and communicating with said air port 62, the coupling head 63 insertable in each said coupling opening in said shoe.

7. A shoe according to claim 2, wherein each said buckle means 7 includes: a buckle body 70 secured on an instep member 4 by a plurality of screws, two straps 71 adjustably fastened on the buckle body 70, each strap 71 having a latch 72 secured to a buckle slot 24 formed in the rear shield 2 and in a side cavity 131 recessed in the sole 1.

8. A shoe according to claim 1, wherein said instep member 4*b* includes: a central flap 40*a* having a shoelace 46 wound in and passing through a plurality of eyelets 461 formed in the central flap 40*a*, a front tab 43 protruding frontwardly from the central flap 40*a* having a front coupling opening 44 formed in the front tab 43 to be matched with a coupling opening 34 formed in the toe box member 3 for securing the front tab 43 with the toe box member 3 by one said ventilation coupling 6, a plurality of side coupling openings 42 formed in two opposite side portions of the central flap 40*a* to match with a plurality of coupling openings 141 formed in two side flaps 14 on the sole 1 for inserting each said ventilation coupling 6 in the coupling openings 141, 42 in the sole 1 and in the instep member 4*b* for securing the instep member 4*b* with the sole 1, and a plurality of latches 47 protruding downwardly from a bottom of the instep member 4*b* each latch 47 engaged with each side cavity 131 recessed in the sole 1 for further securing the instep member 4*b* to the sole 1.

9. A shoe according to claim 1, wherein said instep member 4*c* includes: a pair of central flaps 40*b* each central flap 40*b* having two latches 47 secured to the sole 1, and each central flap 40*b* secured with said strap 71 to allow two said straps 71, 71 to be fastened on a buckle means 7 held in a central portion of the instep member 4*c*.

* * * * *

UNITED STATES PATENT AND TRADEMARK OFFICE

CERTIFICATE OF CORRECTION

PATENT NO. : 5,357,695

DATED : October 25, 1994

INVENTOR(S) : Jinny Lu

It is certified that error appears in the above-indentified patent and that said Letters Patent is hereby corrected as shown below:

On the title page, item 73 "Montype" should read --Monotype--.

Signed and Sealed this

Twenty-fifth Day of February, 1997

*Attest:*

Bruce Lehman

BRUCE LEHMAN

*Attesting Officer*

*Commissioner of Patents and Trademarks*